US005775042A

United States Patent [19]

Mowery et al.

[11] Patent Number: 5,775,042

[45] Date of Patent: Jul. 7, 1998

[54] SIDING PANEL WITH INTERLOCKING PROJECTION

[75] Inventors: Jack T. Mowery, Medina; Benjamin L. McGarry, Akron, both of Ohio

[73] Assignee: Associated Materials, Incorporated, Akron, Ohio

[21] Appl. No.: 843,872

[22] Filed: Apr. 17, 1997

[51] Int. Cl.[6] ..... E04C 2/30; E04D 1/00

[52] U.S. Cl. ..... 52/520; 52/748.1; 52/748.11; 52/588.1; 52/523; 52/539; 52/555

[58] Field of Search ..... 52/519, 520, 522–526, 52/539, 555, 588.1, 748.11, 748.1, 546

[56] References Cited

U.S. PATENT DOCUMENTS

| | | | |
|---|---|---|---|
| 1,891,187 | 12/1932 | Plym . | |
| 2,739,676 | 3/1956 | Tomita . | |
| 3,417,531 | 12/1968 | Jones . | |
| 3,507,079 | 4/1970 | George . | |
| 3,969,866 | 7/1976 | Kyne . | |
| 4,054,012 | 10/1977 | Paradisi et al. . | |
| 4,122,643 | 10/1978 | Hafner | 52/520 |
| 4,272,576 | 6/1981 | Britson . | |
| 4,411,117 | 10/1983 | Bolha | 52/520 X |
| 4,424,655 | 1/1984 | Trostle | 52/520 |
| 4,648,218 | 3/1987 | Butzen . | |
| 4,736,565 | 4/1988 | Bisson . | |
| 5,363,623 | 11/1994 | King | 52/520 |
| 5,461,839 | 10/1995 | Beck . | |
| 5,526,627 | 6/1996 | Beck . | |

FOREIGN PATENT DOCUMENTS

| | | | |
|---|---|---|---|
| 492358 | 4/1953 | Canada . | |
| 1011076 | 5/1977 | Canada | 20/66 |
| 1171825 | 7/1984 | Canada | 235/74 |

*Primary Examiner*—Robert Canfield
*Attorney, Agent, or Firm*—Banner & Witcoff, Ltd.

[57] ABSTRACT

Wall siding for installation on the walls of a structure comprising a plurality of panels, each comprising a nailing hem, a flange member, upper and lower declinations being substantially planar and extending downwardly and slightly outwardly from the nailing hem, and a downwardly opening U-shaped channel formed between and interconnecting the flange member and the upper declination. Upper and lower shoulders extend inwardly and substantially horizontally from lower edges of the upper and lower shoulders, respectively. A lip extends upwardly and curves slightly outwardly from an innermost edge of the lower shoulder. An inverted U-shaped projection extends substantially along the length of the upper shoulder and a slot extends from a vertical edge of the siding panel along a portion of the upper shoulder. When installed, the lip of a siding panel mates with and engages the U-shaped channel of a vertically adjacent panel in a male-female relationship, and the projection of a siding panel mates with and engages the slot of a horizontally adjacent panel in a male-female relationship. Siding panels having more than two declinations are also disclosed.

20 Claims, 3 Drawing Sheets

SIDING PANEL WITH INTERLOCKING PROJECTION

INTRODUCTION

The present invention is directed to siding panels, and, more particularly, to siding panels having projections and slots which serve to interlock adjacent panels.

BACKGROUND

Siding, or wall siding, is commonly used to cover the exterior walls of structures. Wall siding is often formed of metal such as aluminum or thermoplastic materials such as polyvinyl chloride (PVC). The siding is typically formed with declinations, that is, downwardly and outwardly extending flat portions, which combine with horizontal shoulders to form a clapboard profile.

The siding is installed in multiple horizontal rows of panels, each row typically consisting of multiple overlapping panels and each row overlapping the row below and to which it is adjacent. Adjoining panels are overlapped in this manner to provide protection for the structure from the elements. The vertical edges of a panel which is overlapping a horizontally adjacent panel tend to separate from the overlapped panel, forming unsightly and potentially problematic gaps between horizontally adjacent panels. These gaps can allow wind to get behind the panels and possibly lead to panels being blown off the structure. The panels also tend be very flexible, leading to problems in handling as well as bowing and other variations along the surface of the siding panels which are fastened to wall surfaces which may themselves have variations along their surface.

A siding panel known in the prior art and formed by an extrusion process using profile tooling is shown in FIG. 5. Siding panel 1 comprises upper declination 3 and lower declination 5 joined by horizontally extending shoulder 7. When installed, a lower panel 1' is fastened to structure 19 proximate flange 9 by nails. The next vertically adjacent panel 1 is secured to the lower panel 1 by means of a small lip 11, which extends upwardly from a rear edge of a lower shoulder 13, engaging with flange 9 of the lower panel. Similarly, a next vertically adjacent panel 1" is installed in the same manner. A small nub 15 extends upwardly from a rear edge of shoulder 7 and mates with a slot (not shown) formed in a horizontally adjacent panel. The engagement of this small nub with the adjacent panel is not very effective and also does not significantly increase the rigidity of the panel 1 along its length. Another problem associated with the siding panels of the prior art is their aesthetic appeal. When two vertically adjacent panels 1 are installed, a slight gap 21 is formed where lip 11 engages with flange 9. This gap, when viewed from below, appears as a dark or black line. Where the other shoulders 7 meet the lower declinations 5, no such gap and therefore no dark or black line appears. In typical installations, each panel comprises two declinations, therefore, a dark or black line appears only at the rear edge of every other shoulder. This inconsistent look lacks aesthetic appeal when viewed from below, and this is especially apparent on a two story structure where a large amount of siding can be seen from below.

In certain siding panels known in the prior art, the horizontal shoulders are sloped slightly downward from their inner edge toward their outer edge in an attempt to engage a horizontally adjacent panel and resist the separation of adjacent panels. The engagement of sloped shoulders of adjacent panels is not very effective, adds no rigidity to the panels, and is less aesthetically pleasing.

It is an object of the present invention to provide improved wall siding which reduces or wholly overcomes some or all of the aforesaid difficulties inherent in prior known devices. Particular objects and advantages of the invention will be apparent to those skilled in the art, that is, those who are knowledgeable and experienced in this field of technology, in view of the following disclosure of the invention and detailed description of certain preferred embodiments.

SUMMARY OF THE INVENTION

The principles of the invention may be used to advantage to provide a plurality of wall siding panels having projections and corresponding slots to provide an interlocking engagement between horizontally adjacent panels.

In accordance with a first aspect, each panel comprises a nailing hem, a flange member, upper and lower declinations, and a downwardly opening U-shaped channel formed between and interconnecting the flange member and the upper declination. The term nailing hem, when used herein, refers to a portion of the panel which is substantially planar and typically extends along an upper edge of the panel. Upper and lower shoulders extend inwardly and substantially horizontally from lower edges of the upper and lower declinations, respectively. A lip extends upwardly and curves slightly outwardly from an innermost edge of the lower shoulder. A projection extends upwardly from and substantially along the length of the upper shoulder. A slot extends from a vertical edge of the siding panel along a portion of the upper shoulder. When installed, the lip of each siding panel engages within the U-shaped channel of the next vertically adjacent panel in a male-female engaging relationship, and the projection of each siding panel positively engages with the slot of the next horizontally adjacent panel in a male-female engaging relationship.

In accordance with a second aspect, each panel comprises a nailing hem, a flange member, three or more declinations, and a downwardly opening U-shaped channel formed between and interconnecting the flange member and the uppermost declination. Shoulders extend inwardly and substantially horizontally from lower edges of each declination. A lip extends upwardly and curves slightly outwardly from an innermost edge of the lowermost shoulder. Projections extend upwardly from and substantially along the length of all shoulders with the exception of the lowermost shoulder. Slots extend from a vertical edge of the siding panel along a portion of all shoulders with the exception of the lowermost shoulder. When installed, the lip of each siding panel engages the U-shaped channel of the next vertically adjacent panel in a male-female and interlocking relationship, and the projections of a siding panel positively engage with the corresponding slots of the next horizontally adjacent panel in a male-female engaging relationship.

From the foregoing disclosure, it will be readily apparent to those skilled in the art that the present invention provides a significant technological advance. Substantial advantage is achieved by providing siding panels having such projections and slots. In particular, increased rigidity as well as positive engagement between adjacent panels is achieved. This is highly advantageous as it tends to improve the appearance of the siding and its structural integrity. Additionally, a consistent look is achieved along the entire panel when viewed from below, thereby adding to the aesthetic appeal of the siding. These and additional features and advantages of the invention disclosed here will be further understood from the following detailed disclosure of certain preferred embodiments.

BRIEF DESCRIPTION OF THE DRAWINGS

Certain preferred embodiments are described in detail below with reference to the appended drawings wherein.

Figure 1:
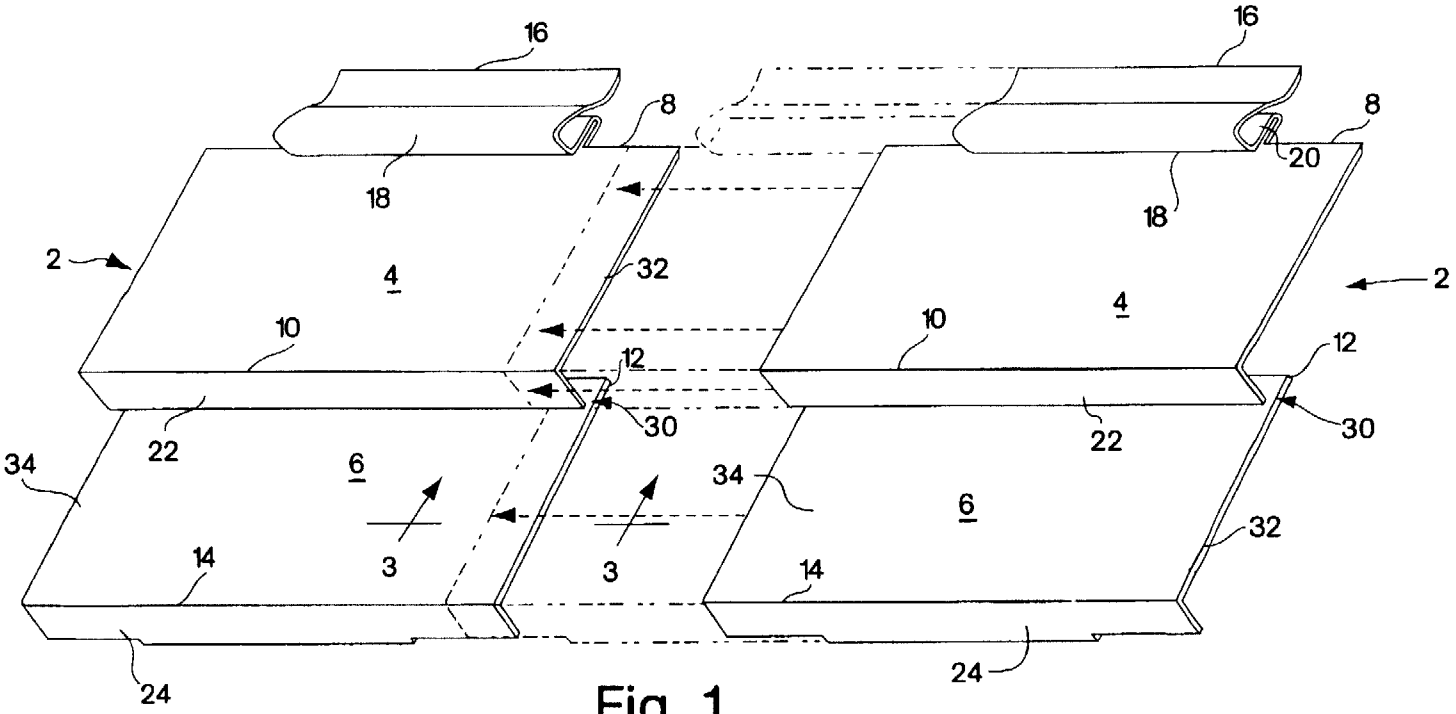
FIG. 1 is a schematic perspective view in exploded form of two horizontally adjacent siding panels of the present invention.

The figures referred to above are not drawn to scale and should be understood to present a simplified representation of the invention, illustrative of the basic principles involved. Some features of the siding panel with interlocking projection depicted in the drawings have been enlarged or distorted relative to others to facilitate explanation and understanding. The same reference numbers are used in the drawings for similar or identical components and features shown in various alternative embodiments. The siding panel with interlocking projection, as disclosed above, will have configurations and components determined, in part, by the intended application and environment in which it is used.

DETAILED DESCRIPTION OF CERTAIN PREFERRED EMBODIMENTS

Unless otherwise stated, or otherwise clear from the context below, directional references used here are based on the orientation of components and assemblies shown in the appended drawings. These directional references assume wall siding attached to the walls of a structure such as a house. These directional references are given in reference to the surface plane, such as the ground, upon with the structure sits, and the plane of the wall of the structure itself. Horizontal, therefore, refers to a direction which is substantially parallel to the surface plane and substantially perpendicular to the wall of the structure. Vertical refers to a direction which is substantially parallel to the wall of the structure and substantially perpendicular to the surface. Outwardly refers to a direction moving substantially horizontally away from the structure upon which the siding is attached while inwardly refers to a direction moving substantially horizontally toward the structure. Downwardly refers to a direction moving substantially vertically toward the surface and upwardly refers to a direction moving substantially vertically away from the surface. Lower and upper refer to vertical directions with lower being closer to the surface than upper. Left and right are in reference to directions given when one is looking at the structure.

Figure 2:
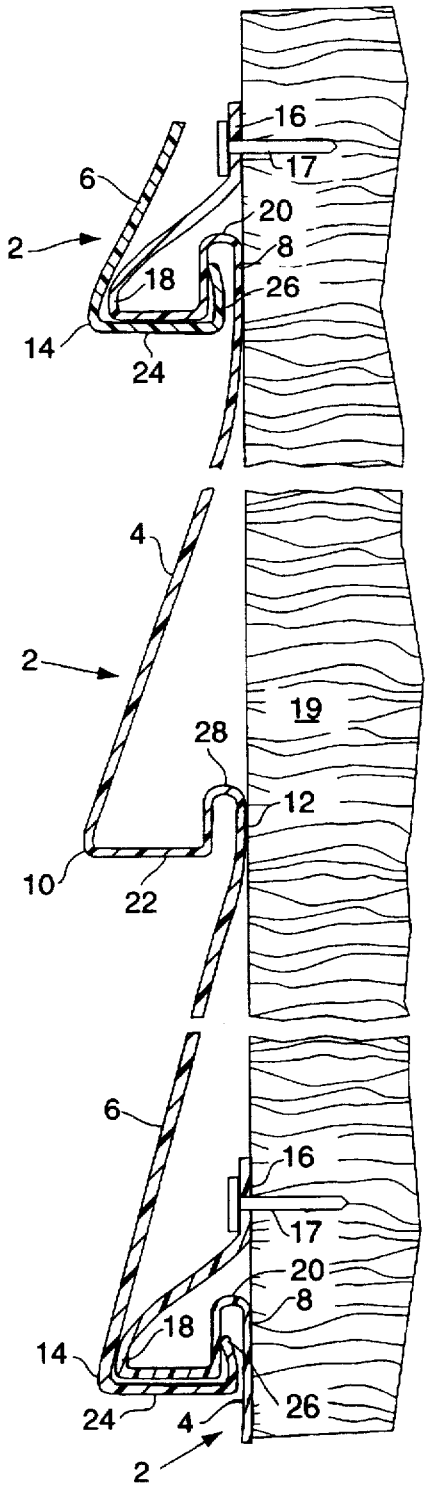
FIG. 2 is a schematic section view, shown partially cut away, of three vertically adjacent, overlapping, and interlocking siding panels of the present invention.

A first preferred embodiment of a siding panel or panel, designated generally by the reference numeral 2, is shown in FIG. 1. Panel 2 comprises upper declination 4 and lower declination 6, having upper edges 8, 12 and lower edges 10, 14, respectively and right and left vertical edges 32, 34. The term declination, when used herein, refers to a substantially planar portion of the panel 2 which slopes downwardly and slightly outwardly from an upper edge. Nailing hem 16 extends substantially along the upper edge of panel 2. As shown in FIG. 2, nails 17 or other suitable fastening means are typically driven through nailing hem 16 to secure panel 2 to the structure 19 upon which it is fastened. Referring now to FIG. 1, flange member 18 connects nailing hem 16 to upper declination 4 and extends substantially along the length of panel 2. Portions of flange member 18 and nailing hem 16 are removed, at the time of manufacture or at another time prior to installation, along the right and left vertical edges 32, 34, exposing portions of upper edge 8. In a preferred embodiment, approximately two inches of flange member 18 and nailing hem 16 are removed. A downwardly opening U-shaped channel 20 is formed integrally to flange member 18 where it meets upper edge 8 of upper declination 4. Upper shoulder 22 extends inwardly and substantially horizontally from lower edge 10 of upper declination 4. Lower shoulder 24 extends inwardly and substantially horizontally from lower edge 14 of lower declination 6. Upper declination 4, upper shoulder 22, lower declination 6, and lower shoulder 24 combine to give panel 2 a clapboard siding appearance. Lip 26, as seen in FIG. 2, is formed integrally to lower shoulder 24 and extends substantially upwardly while curving slightly outwardly from an innermost edge of lower shoulder 24. Portions of lower shoulder 24 and lip 26 are removed, at the time of manufacture or at another time prior to installation, extending from the right and left vertical edges, exposing portions of lower edge 14 of lower declination 6. In a preferred embodiment approximately two inches of lower shoulder 24 and lip 26 are removed, or approximately the same amount as was removed from flange member 18 and nailing hem 16.

Figure 3:
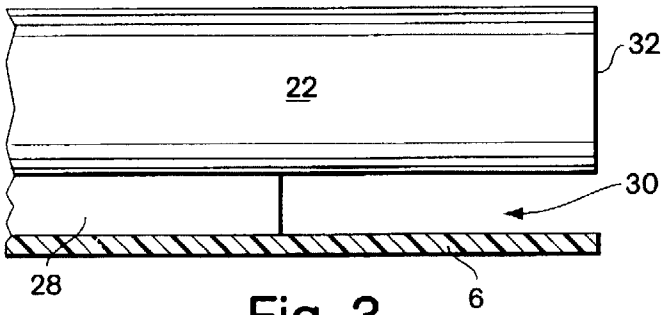
FIG. 3 is a schematic section view, shown partially cut away, and taken along line 3—3 of FIG. 1 of a shoulder of a siding panel of the present invention.

Referring now to FIG. 2, projection 28, preferably formed with an inverted U-shaped profile, is formed between and interconnects upper shoulder 22 to upper edge 12 of lower declination 6. Projection 28 extends substantially along the length of shoulder 22. In a preferred embodiment projection 28 extends along the entire length of shoulder 22. Slot 30, seen more clearly in FIG. 3, is formed in shoulder 22 by removing a portion of projection 28, and extends from a vertical edge, e.g. the rightmost edge 32, of panel 2 partially along the length of shoulder 22. In a preferred embodiment the length of slot 30 is about 2 inches. It is to be appreciated that slot 30 may extend from the leftmost edge 34 of panel 2 instead of from the rightmost edge 32. The side from which slot 30 extends is chosen based on which of two horizontally adjacent panels overlaps the other.

In another embodiment, panel 2 may comprise three or more declinations, each having a structure corresponding to the declinations of the embodiment shown in FIG. 1, with the uppermost declination connected to the flange member, the lowermost of the declinations having a lip formed along its shoulder, and the remainder of the shoulders having corresponding projections and slots like those of the embodiment depicted in FIG. 1.

In a preferred embodiment, siding panel 2 is manufactured in a post forming process. The first step in a post forming process is the extrusion of a flat sheet in a known extruding manner. The flat sheet is then shaped by calibration to form a desired profile. The extrusion of flat sheets has been found to be a more efficient and faster method than the prior art process of extruding a siding panel with profile tooling. The post forming process thereby can reduce costs, increase efficiency and increase yield in the manufacture of siding panels.

The vertical overlapping manner in which the siding panels are installed can be seen in FIG. 2. A first panel 2 (shown partially cut away as the lowermost panel) is fastened to structure 19 via nails 17 or other suitable fasteners which are driven through nailing hem 16. A second panel 2' is installed directly above the first panel 2 with lip 26 of the second panel 2' mating with channel 20 of the flange member 18 of the first panel 2 in a male-female relationship. As shown in FIG. 2, flange member 18 may be formed in a manner such that it mates with and fits within the space created by lower declination 6, lower shoulder 24, and lip 26. The second panel 2' is then nailed to structure 19 along its nailing hem 16 and the process is repeated with a third panel 2" installed above the second panel 2' with lip 26 of the third panel 2" mating with channel 20 of the second panel 2' in a similar male-female manner. This mating engagement ensures that vertically adjacent and overlapping panels are securely mated to one another.

Figure 4:
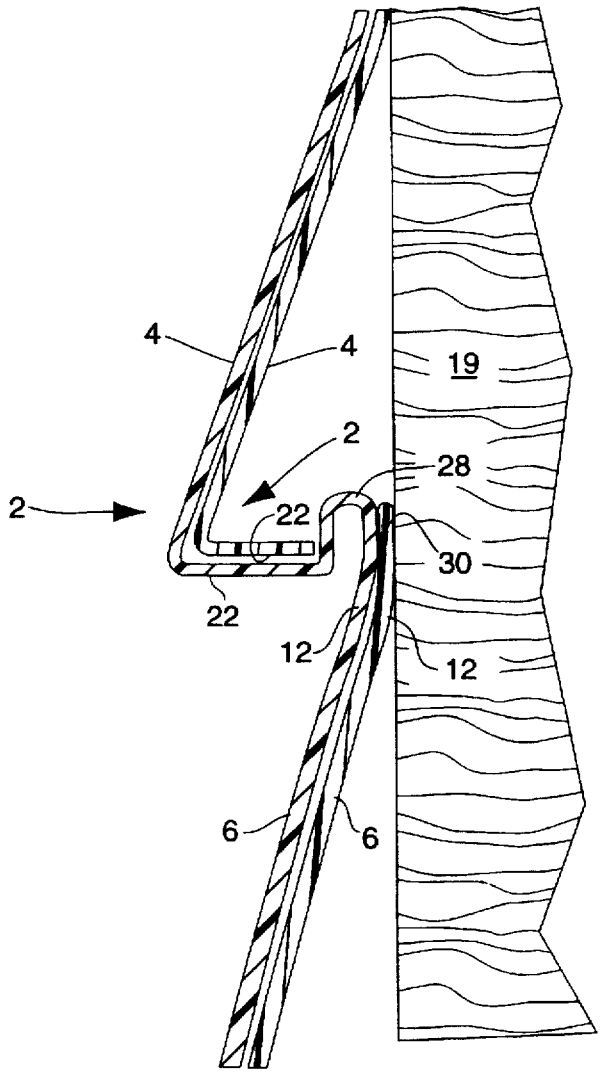
FIG. 4 is a schematic section view, shown partially cut away, of two horizontally adjacent and overlapping siding panels of the present invention.
Figure 5:
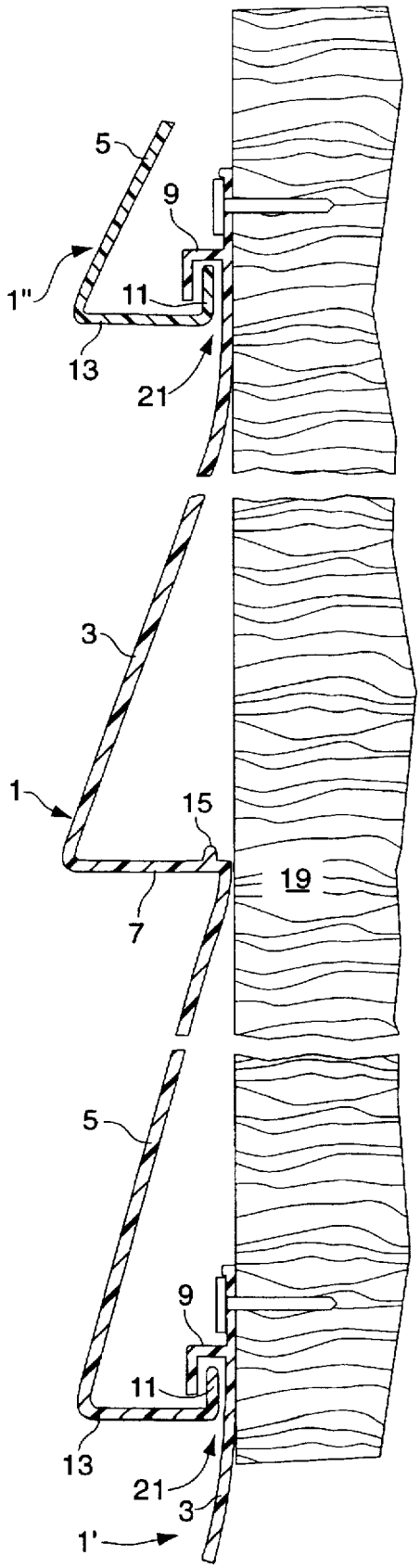
Fig. 5 (Prior Art)
FIG. 5 is a schematic section view, shown partially cut away, of three vertically adjacent, overlapping, and interlocking siding panels of the prior art.

The horizontal overlapping manner in which two adjacent panels are installed can be seen in FIGS. 1 and 4. It is to be appreciated that horizontally adjacent panels can be overlapped left over right or right over left depending on the selection of the vertical edge from which slot 20 extends. FIG. 1 depicts a right over left overlapping embodiment. After the leftmost of the two panels 2 is secured to the structure via nails driven through nailing hem 16, the rightmost panel is placed such that it overlaps a portion of the leftmost panel (as indicated by the dashed lines in FIG. 1). In a preferred embodiment, the two panels 2 are overlapped approximately one inch. Projection 28, as seen in FIG. 4, of the rightmost panel 2 mates within slot 30 of the leftmost panel 2 in a male-female engaging relationship, thereby positively engaging and interlocking the horizontally adjacent panels. Further horizontally adjacent panels 2 are overlapped with one another in a similar manner.

In a preferred embodiment, panel 2 is formed of one piece construction, that is, from one piece of material. Such construction provides for improved manufacturability, reduced costs, reduced complexity and improved handling. Panel 2 may be formed of, for example, rigid polyvinyl chloride (PVC) or other suitable materials which will become readily apparent to those skilled in the art, that is, those with knowledge or experience in this particular field, given the benefit of this disclosure. In a preferred embodiment, panel 2 is formed of a sheet of PVC having a thickness of about 0.04 inches, and more preferably about 0.042 inches.

Projections 28 advantageously provide added rigidity to panel 2. The increased rigidity of panel 2 helps improve the aesthetic appeal of the panels as the panels will have a reduced bow or flex along the surface of the wall to which they are fastened and cover. The positive engagement of projections 28 within slots 30 provides a secure interlocking engagement of horizontally adjacent panels along a central portion of their vertical edges 32, 34. The interlocking of the horizontally adjacent panels helps to reduce unsightly gaps which can form between panels that are not secured to one another in such a manner. Since the panels tend to expand and contract over time depending on the material selected and environmental factors, the interlocking feature of the panels helps reduce gaps that may form between horizontally adjacent panels due to expansion and contraction.

In light of the foregoing disclosure of the invention and description of certain preferred embodiments, those who are skilled in this area of technology will readily understand that various modifications and adaptations can be made without departing from the true scope and spirit of the invention. All such modifications and adaptations are intended to be covered by the following claims.

We claim:

1. A siding panel manufactured in a post forming operation to be installed in an overlapping manner and in a male-female engaging relationship with other horizontally and vertically adjacent siding panels comprising, in combination:

a nailing hem;

a flange member connected to the nailing hem;

an upper declination having an upper edge connected to the flange member, and a lower edge;

a lower declination having an upper edge and a lower edge;

an upper shoulder extending inwardly and substantially horizontally between the lower edge of the upper declination and the upper edge of the lower declination;

a projection extending substantially along the length of the upper shoulder;

a lower shoulder extending inwardly and substantially horizontally from the lower edge of the lower declination;

a slot extending from an outer edge and along a portion of the upper shoulder, the slot being shaped to receive a portion of the projection of a horizontally adjacent panel; and a lip extending upwardly from an innermost edge of the lower shoulder to mate with and engage the flange member of a vertically adjacent panel in a male-female relationship.

2. A siding panel in accordance with claim 1 wherein the projection extends along the entire length of the shoulder.

3. A siding panel in accordance with claim 1 wherein the projection has an inverted U-shape and is formed between and interconnects the upper shoulder and the upper edge of the lower declination.

4. A siding panel in accordance with claim 3 wherein the slot extends along the upper shoulder a distance of about 2 inches.

5. A siding panel in accordance with claim 1 wherein a portion of the nailing hem, a portion of the flange member, a portion of the lower shoulder, and a portion of the lip of each panel are each cut away to allow a horizontally adjacent panel to overlap the panel.

6. A siding panel in accordance with claim 1 wherein the panel is of one piece construction.

7. A siding panel in accordance with claim 6 wherein the panel is formed of polyvinyl chloride.

8. A siding panel in accordance with claim 1 further comprising a downwardly opening U-shaped channel formed between and interconnecting the flange member and the upper edge of the upper declination and adapted to receive the lip of a vertically adjacent panel in an interlocking relationship.

9. A siding panel in accordance with claim 8 wherein the lip is adapted to mate with and engage the U-shaped channel of a vertically adjacent panel in a male-female engaging relationship.

10. A siding panel in accordance with claim 1 wherein the lip curves upwardly and outwardly from the innermost edge of the lower shoulder.

11. A siding panel in accordance with claim 1 wherein the projection is adapted to positively engage and interlock with a slot of a horizontally adjacent panel.

12. A siding panel to be installed in an overlapping manner and in a male-female engaging relationship with other horizontally and vertically adjacent siding panels comprising in combination:

a nailing hem;

a flange member connected to the nailing hem;

an upper declination having an upper edge and a lower edge;

a downwardly opening U-shaped channel formed between and interconnecting the flange member and the upper edge of the upper declination;

a lower declination having an upper edge and a lower edge;

an upper shoulder extending inwardly and substantially horizontally between the lower edge of the upper declination and the upper edge of the lower declination;

a lower shoulder extending inwardly and substantially horizontally from the lower edge of the lower declination;

an inverted U-shaped projection formed between and interconnecting the upper shoulder and the upper edge of the lower declination and extending substantially along the length of the panel;

a slot extending from an outer edge and along a portion of the upper shoulder, the slot being shaped to receive a portion of the U-shaped projection of a horizontally adjacent panel and positively engage therewith;

a lip extending upwardly and curving slightly outwardly from an inner edge of the lower shoulder to mate with and engage the U-shaped channel of a vertically adjacent panel in a male-female relationship.

13. A siding panel in accordance with claim 12 wherein the projection extends along the entire length of the shoulder.

14. A siding panel in accordance with claim 12 wherein the panel is of one-piece construction.

15. A siding panel to be installed in an overlapping manner and in a male-female engaging relationship with other horizontally and vertically adjacent siding panels comprising in combination:

a nailing hem;

a flange member extending downwardly from the nailing hem;

a plurality of declinations having an upper edge and a lower edge, and extending downwardly and outwardly, a first uppermost declination of the plurality of declinations connected at its upper edge to the flange member;

a plurality of shoulders, each shoulder extending substantially horizontally and inwardly from the lower edge of a corresponding one of the plurality of declinations;

at least one projection extending substantially along the length of a corresponding at least one shoulder;

at least one slot extending from an outer edge of a corresponding at least one shoulder along a portion of the respective shoulder, the slot being shaped to receive a portion of the projection of a horizontally adjacent panel and positively engage therewith;

a lip extending upwardly from an inner edge of the lowermost of the shoulders to mate with and engage the flange member of a vertically adjacent panel in a male-female relationship.

16. A siding panel in accordance with claim 15 wherein the panel is of one-piece construction.

17. A siding panel in accordance with claim 15 further comprising a downwardly opening U-shaped channel formed between and interconnecting the upper edge of the first of the plurality of declinations and the flange member.

18. A siding panel in accordance with claim 15 wherein the projection is an inverted U-shaped projection.

19. A siding panel in accordance with claim 15 wherein the projection extends along the entire length of the shoulder.

20. A method of securing and overlapping horizontally adjacent siding panels to a wall of a structure comprising the steps of:

providing first and second panels, each panel comprising a nailing hem, a flange member connected to the nailing hem, an upper declination having an upper edge connected to the flange member and a lower edge, a lower declination having an upper edge and a lower edge, an upper shoulder extending inwardly and substantially horizontally between the lower edge of the upper declination and the upper edge of the lower declination, a lower shoulder extending inwardly and substantially horizontally from the lower edge of the lower declination, a projection extending substantially along the length of the upper shoulder, a slot extending from an outer edge and along a portion of the upper shoulder, the slot being shaped to receive a portion of the projection of a horizontally adjacent panel, a lip extending upwardly from an innermost edge of the lower shoulder to mate with and engage the flange member of a vertically adjacent panel in a male-female relationship;

removing a portion of the nailing hem and a portion of the flange member of the first panel thereby exposing a portion of the upper edge of the upper declination of the first panel extending from a vertical edge of the first panel partially along the length of the first panel;

removing a portion of the lower shoulder and a portion of the lip of the first panel thereby exposing a portion of the lower edge of the lower declination of the first panel extending from a vertical edge of the first panel partially along the length of the first panel;

securing the first panel to the wall;

engaging the projection of the first panel with the slot of the second panel in an interlocking manner; and securing the second panel to the wall.

* * * * *